US007040069B2

(12) United States Patent
Simmons

(10) Patent No.: US 7,040,069 B2
(45) Date of Patent: May 9, 2006

(54) LONG-SPAN TRANSITION BEAM

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 60 days.

(21) Appl. No.: 10/931,156

(22) Filed: Aug. 30, 2004

(65) Prior Publication Data

US 2005/0055970 A1 Mar. 17, 2005

Related U.S. Application Data

(60) Provisional application No. 60/503,072, filed on Sep. 14, 2003.

(51) Int. Cl.
*E04H 9/02* (2006.01)

(52) U.S. Cl. ..... 52/729.1; 52/740.8; 52/644

(58) Field of Classification Search ..... 52/729.1, 52/740.8, 644, 690; 14/13
See application file for complete search history.

(56) References Cited

U.S. PATENT DOCUMENTS 620,561 A * 3/1899 Bettendorf ..... 52/729.1
1,725,439 A * 8/1929 Carns ..... 52/739.1
1,843,318 A * 2/1932 Frease ..... 52/690
2,739,822 A * 3/1956 Schilberg ..... 280/794
3,141,531 A * 7/1964 Montgomery ..... 52/634
3,283,464 A * 11/1966 Litzka ..... 52/636
3,442,542 A * 5/1969 Wantanabe ..... 403/300
4,630,547 A * 12/1986 Przybylinski et al. ..... 105/416
5,148,642 A * 9/1992 Plumier et al. ..... 52/167.1
5,291,704 A * 3/1994 Savorani ..... 52/177
5,595,040 A * 1/1997 Chen ..... 52/729.1
5,671,573 A * 9/1997 Tadros et al. ..... 52/223.8

* cited by examiner

*Primary Examiner*—Carl D. Friedman
(74) *Attorney, Agent, or Firm*—Jon M. Dickinson PC

(57) ABSTRACT

An elongate, long-span transition beam employable between columns in a building frame structure. This transition beam includes (a) an elongate central portion having one, principal cross-sectional vertical depth, and (b) joined to the opposite ends of the central portion, a pair of elongate end portions each having a smaller cross-sectional vertical depth. These end portions may be formed with flange-modified reduced beam sections to act as "overload fuses". The central and end portions join through size-differentiated, transverse cross section, transitional regions which are formed adjacent opposite ends, and as parts, of the central portion.

2 Claims, 2 Drawing Sheets

LONG-SPAN TRANSITION BEAM

CROSS-REFERENCE TO RELATED APPLICATION

This application claims the benefit of the filing date, Sep. 14, 2003, of U.S. Provisional Patent Application Ser. No. 60/503,072, filed by Robert J. Simmons for "Long-Span Transition Beam". The entire contents of that prior-filed application are hereby incorporated herein by reference.

BACKGROUND AND SUMMARY OF THE INVENTION

The present invention relates to building frame construction, and in particular to a unique long-span cross-sectional size-transitioning beam which interacts and cooperates in a special way adjacent its opposite ends with a pair of upright columns to which it is attached in a frame.

As will be seen, the actual dimensions which are chosen for a given beam constructed in accordance with the invention are "fluid". They are fluid in the sense that they, and their relationships to one another, are determined principally in relation to the particular building frame and associated columns with respect to which the subject beam is intended to function to handle loads. Thus, one will recognize, on reading the disclosure of this invention in light of the several provided drawings, that the principles and fundamental architectural structure of the beam of this invention are independent of selected dimensions.

Essentially, the beam of this invention is specially configured to span, and to enable the safe employment of, relatively long reaches between columns in a building so as to minimize the overall "column count" in the building's frame structure, and to do this without "presenting" to connecting columns the functional "appearance" of possessing so much robustness that the failure-mode principle known in the art as "strong column/weak beam" is violated. This important principle is traditionally honored, and is also honored by the present invention, so that in the event of a severe moment load being delivered to a building frame structure, it will be the beams therein rather than the columns which are the first to fail.

According to a preferred and best-mode embodiment of the invention (described herein), the proposed beam offers the above generally described behavior with an elongate structure whose cross-sectional configuration transitions between its ends in the order, generally, of: (a) small section (STCS); (b) reduced beam section (RBS), or fuse; (c) small section (STCS); (d) large section (LTCS); (e) small section (STCS); (f) reduced beam section (RBS); and (g) small section (STCS). In the preferred embodiment of the invention, each of these sections has an I-beam-type configuration. While it is preferable in many if not most situations to have opposite end regions of the proposed beam include RBS structure, such structure can, in certain instances, be eliminated.

The various features and advantages of the invention will now become more fully apparent as the detailed description presented below is read in conjunction with the accompanying drawings.

DETAILED DESCRIPTION OF THE INVENTION

Figure 1:
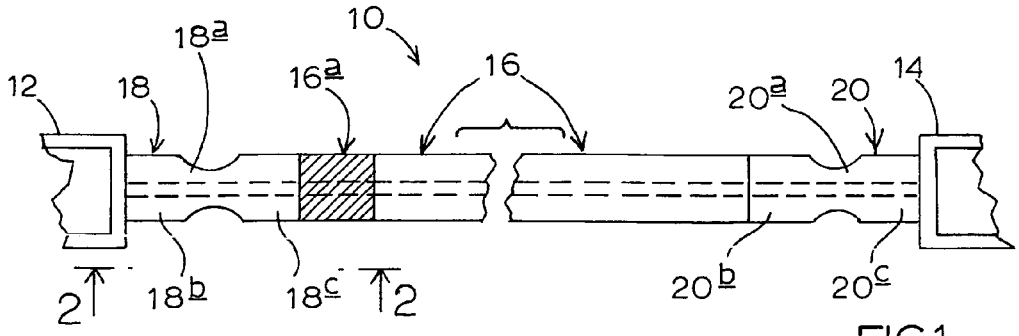
FIG. 1 shows a fragmentary plan view of a preferred and best-mode embodiment of the transition beam of this invention.

Turning now to the drawings, and referring first of all to FIGS. 1–5, inclusive, indicated generally at 10 is a long-span transition beam which is constructed in accordance with a preferred and best-mode embodiment of the invention. The left end of this beam in FIGS. 1–3, inclusive, is shown suitably anchored to the side of a column 12 and the right end of beam 10 is shown in FIG. 1 appropriately anchored to the side of another, laterally spaced column 14. Columns 12, 14 herein are illustrated as being hollow (tubular) and square in cross section, and preferably formed of a suitable steel. The distance between columns 12, 14 is what is considered in the building frame art to be a long span, and this particular distance will, of course, vary from situation to situation.

Beam 10 includes an elongate central portion, or large transverse cross-section section (LTCS) 16, and a pair of elongate end portions 18, 20 which are joined to the opposite ends of portion 16. End portion 18 includes a central reduced beam section (RBS) fuse structure 18*a* having the configuration clearly shown for it in the drawings, with this RBS structure being bracketed by two small transverse cross sections (STCS) 18*b*, 18*c*. Similarly, end portion 20 includes a central RBS structure 20*a* bracketed by two STCS sections 20*b*, 20*c*.

Sections 18*b*, 18*c*, 20*b*, 20*c* are also referred to herein respectively as first, second, third and fourth STCS sections, and RBS fuse structures 18*a*, 20*a* as first and second fuse sections, respectively.

All portions/sections of beam 10 herein have I-beam configurations (see especially FIGS. 4 and 5), and are characterized with appropriate vertical cross-sectional dimensions as dictated by the specific building-frame application. Those skilled in the art will understand how to specify such dimensions. And, while a preferred embodiment of the invention is specifically illustrated herein in the context of componentry possessing an I-beam cross section, it should be understood that the invention may be implemented just as well, in certain circumstances, with componentry having different types of cross sections.

Figure 2:
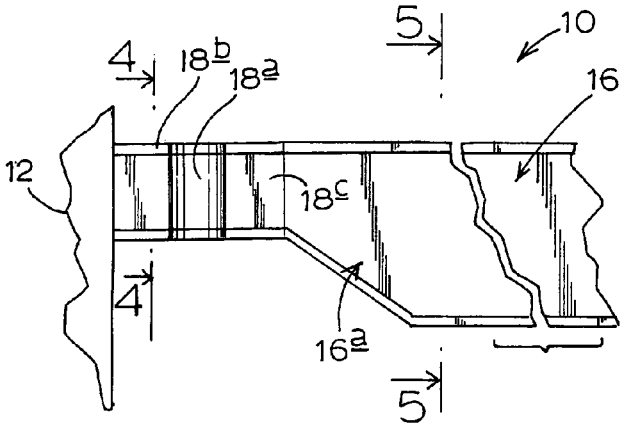
FIG. 2 is an enlarged-scale fragmentary side elevation of the left-hand portion of the beam of FIG. 1, taken generally along the line of 2—2 in FIG. 1.
Figure 3:
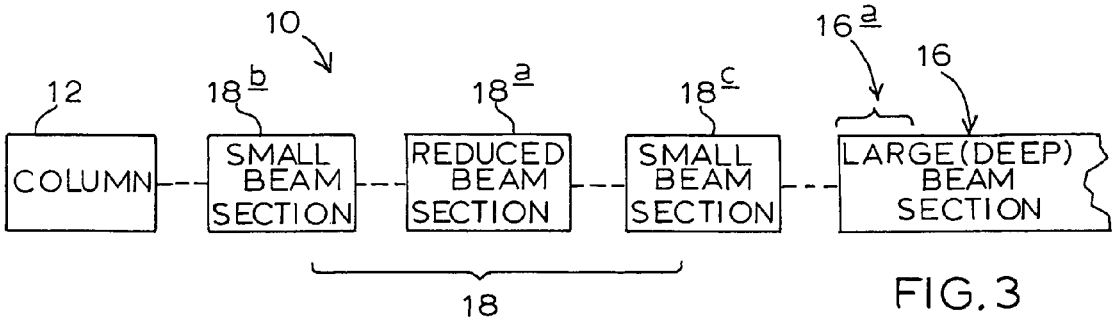
FIG. 3 is a kind of hybrid, block/schematic diagram of the fragmentary structure shown in FIG. 2.
Figure 4:
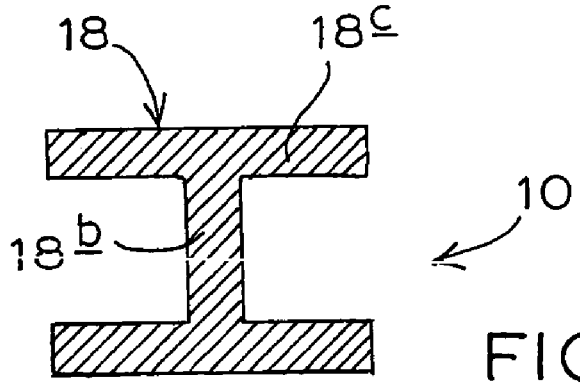
FIGS. 4 and 5 are transverse cross-sectional views taken generally along the lines 4—4 and 5—5 in FIG. 2.
Figure 5:
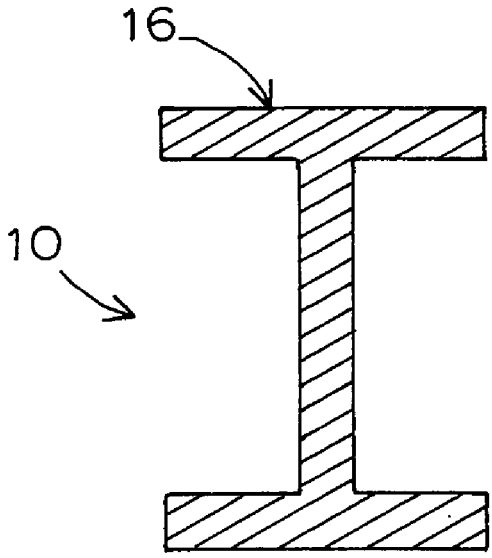

As can be seen best in FIG. 2, each opposite end of central portion 16 (only one being specifically shown) has what is referred to herein as a progressively size-tapering transverse, transitional cross-sectional region (vertical depth), such as region 16*a* (lightly shaded in FIG. 1). There is no single, specific length required for this tapered transition region, and it will be recognized that various lengths can be selected to suit different specific purposes. While a preferred transitional section (size-differentiated in transverse cross section) is one which is tapered as illustrated in FIG. 2, other kinds of transition structure could be employed. For example, the transition region could simply be defined by a sharp discontinuity in vertical dimension. It could also be defined by a region with a larger beam width, or with a varying beam width. Other possibilities also exist.

The RBS structures are conventionally formed as curved cut-out regions in the upper and lower horizontal flanges in the otherwise consistent I-beam cross-sectional configurations defined for end portions 18, 20.

From a study of the configuration just described for beam 10, one can readily see that the cross-sectional size transitions which exist in the beam give its central and end portions quite different moment and gravity load resisting capabilities. Central portion 16 is quite robust in these "departments", while end portions 18, 20 are less so. It is this transitioning, differentiating load-bearing condition in beam 10 which causes it to allow for relatively long spans between next-adjacent building frame columns, such as between columns 12, 14, while definitively "honoring" the strong column/weak beam "principle" mentioned earlier.

By changing the specific and relative transverse cross-sectional sizes in a beam, such as in beam 10, an appropriate long-span transition beam can be created to deal with many different kinds of inter column spacings in building frame structures.

Figure 6:
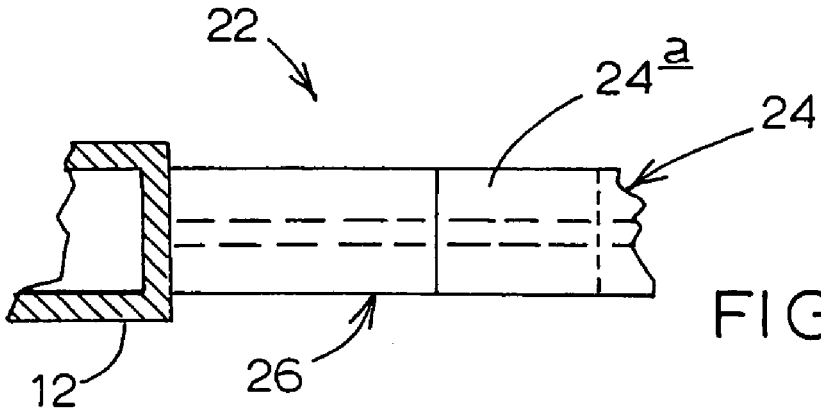
FIG. 6 is a fragmentary view, on a slightly larger scale than that employed in FIG. 1, illustrating an end region of a modified form of transition beam made in accordance with the invention.

Shifting attention now to FIG. 6, here there is shown at 22 the left end (in this figure) of a modified form of long-span transition beam constructed in accordance with the invention, and suitably anchored to column 12. Included in beam 22 are a central portion, or section 24, opposite ends of which join through vertically tapered transition regions, such as region 24*a*, with smaller transverse cross section end portions, or sections, such as the one such end section shown at 26 in FIG. 6. Each end portion 26 is like previously described end portions 18, 20, except for the fact that no RBS structure is provided.

A uniquely configured long-span transition beam having all of the general load-carrying and operational (functional) features as described earlier herein has thus been described. The proposed beam is very simple in construction and is easily useable in a wide variety of building frame structures. Depending upon specific load requirements in a particular frame structure, dimensions for various portions of a beam built in accordance with the present invention can be varied.

Accordingly, while a preferred and best-mode embodiment, and one possible modification, have specifically been illustrated and discussed, it is appreciated that other variations and modification may be made without departing from the spirit of the invention.

I claim:

1. An elongate, long-span transmission beam employable between columns in a building frame structure comprising an elongate central portion having a uniform first depth occupying the majority of the overall length of the beam, and having a common cross-section along its length, a pair of elongate end portions each having a uniform second depth which is less than said first depth, and each also having a common cross-section along its length, a pair of elongate depth transitional regions each integrally interposed an end of said central portion and an end of an end portion, possessing a graded depth which transitions in size from said first depth where the transitional region is integral with an end of said central portion to said second depth where the transitional region is integral with an end of an end portion, said central portion, end portions and transitional regions each being characterized by material continuity along lines extending within them which are transverse to the lengths of the portions and regions, and intermediate the opposite ends of each uniform-depth end portion, a laterally reduced beam-section region.

2. The structure of claim 1, wherein said central and end portions each has an I-beam configuration.

* * * * *